US005116241A

United States Patent [19]

Sato

[11] Patent Number: 5,116,241

[45] Date of Patent: May 26, 1992

[54] CONNECTOR TERMINAL

[75] Inventor: Kensaku Sato, Tokyo, Japan

[73] Assignee: Hirose Electric Co., Ltd., Tokyo, Japan

[21] Appl. No.: 659,080

[22] Filed: Feb. 22, 1991

[30] Foreign Application Priority Data

Dec. 14, 1989 [JP] Japan ..... 1-143639

[51] Int. Cl.[5] ..... H01R 31/08

[52] U.S. Cl. ..... 439/511; 439/507; 439/884; 439/49

[58] Field of Search ..... 439/507, 511, 514, 885, 439/49

[56] References Cited

U.S. PATENT DOCUMENTS 4,030,793 6/1977 Hanlon et al. ..... 439/511

4,781,610 11/1988 Mercer ..... 439/217

5,000,699 3/1991 Nadin ..... 439/511

*Primary Examiner*—Paula A. Bradley

*Attorney, Agent, or Firm*—Kanesaka & Takeuchi

[57] ABSTRACT

An electrical connector which includes a connector housing (16) made from an insulation material and having a plurality of receiving apertures (17) and at least one linear shunt terminal (10) having a plurality of terminal pins (11) aligned in line and joined together at base sections (12) with a linkage strip (13) which is made from a conductive material and/or one interconnected shunt terminal (14) having at least one pair of linear shunt terminals aligned in parallel and joined together with a linkage strip which is made from a conductive material, with said terminal pins press fitted into said receiving apertures.

1 Claim, 2 Drawing Sheets

CONNECTOR TERMINAL

BACKGROUND OF THE INVENTION

1. Field of the Invention

The present invention relates generally to connector terminals and, more particularly, to a connector terminal which permits a very reliable electrical connection.

2. Description of the Prior Art

FIG. 5 shows a conventional connector terminal which includes a connector housing 1 having a number of receiving apertures 2; a number of terminal pins 3 press fitted into the receiving apertures 2; and a shunting plate 4 for providing a desired short circuit.

However, with such a structure as described above, it is difficult to provide a reliable connection between the shunting plate 4 and the terminal pins 3. It is especially difficult to provide a reliable connection for a multipole connector which requires a number of shunting plates 4.

SUMMARY OF THE INVENTION

Accordingly, it is an object of the invention to provide a connector terminal which permits a simplified and reliable connection between the terminal pins.

According to the invention there is provided a connector which includes a connector housing made from an insulation material and having a plurality of receiving apertures and at least one linear shunt terminal having a plurality of terminal pins aligned in line and joined together at base sections with a linkage strip which is made from a conductive material and/or one interconnected shunt terminal having at least one pair of linear shunt terminals aligned in parallel and joined together with a linkage strip which is made from a conductive material, with the terminal pins press fitted into the receiving apertures.

The above and other objects, features, and advantages of the invention will be more apparent from the following description when taken in conjunction with the accompanying drawings.

DESCRIPTION OF THE PREFERRED EMBODIMENT

Figure 1:
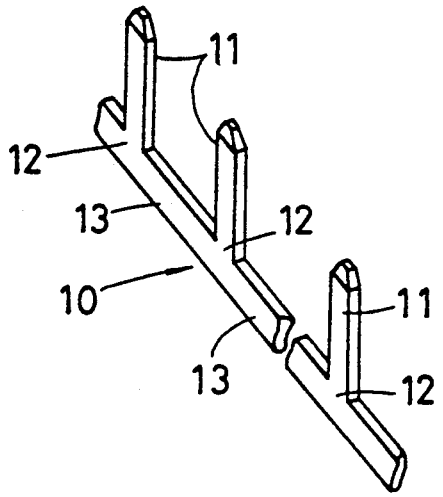
FIG. 1 is a perspective view of a linear shunt terminal according to an embodiment of the invention.

In FIG. 1, a linear shunt terminal 10 has a plurality of terminal pins 11 aligned in line and joined together at the base sections 12 with a linkage strip 13 which is made from a conductive material. The interval between the terminal pins 11 is determined according to the standards.

Figure 2:
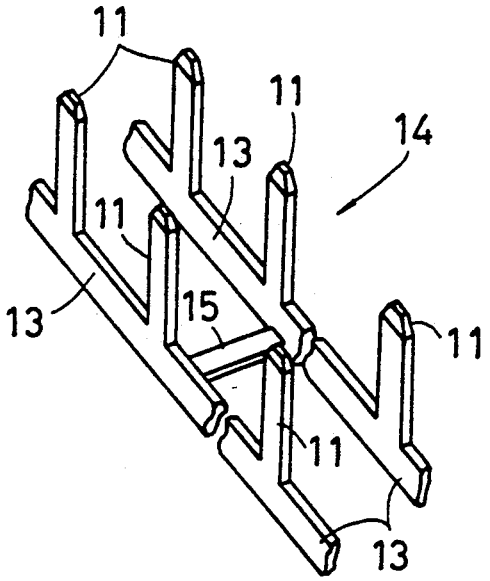
FIG. 2 is a perspective view of an interconnected shunt terminal according to another embodiment of the invention.

In FIG. 2, a interconnected H-shaped shunt terminal 14 consists of a pair of linear shunt terminals 10 disposed in parallel and joined together with a conductive cross linkage strip 15.

Figure 3:
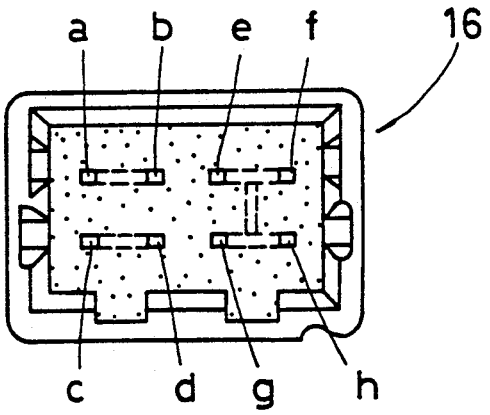
FIG. 3 is a top plan view of a connector in which terminal pins a–b, c–d, and e–f–g–h are shunted according to the invention.

In FIG. 3, a pair of linear shunt terminals 10 and an interconnected shunt terminal 14 are used for providing the desired short circuit configuration in which terminal pins a–b, c–d, and e–f–g–h are shunted, respectively, within a connector housing 16.

Figure 4:
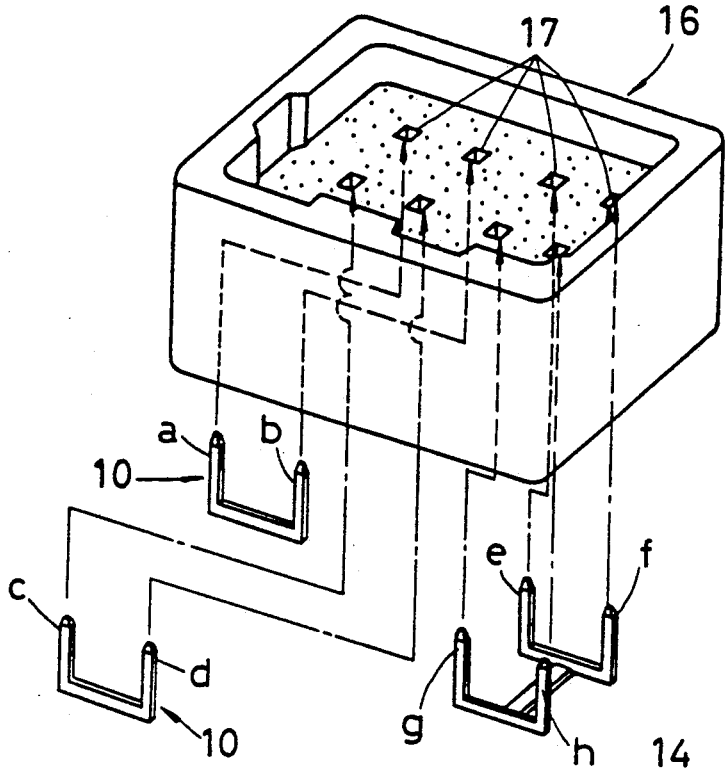
FIG. 4 is a perspective view showing how to install a pair of linear shunt terminals and an interconnected shunt terminal in the connector housing according to the invention.
Figure 5:
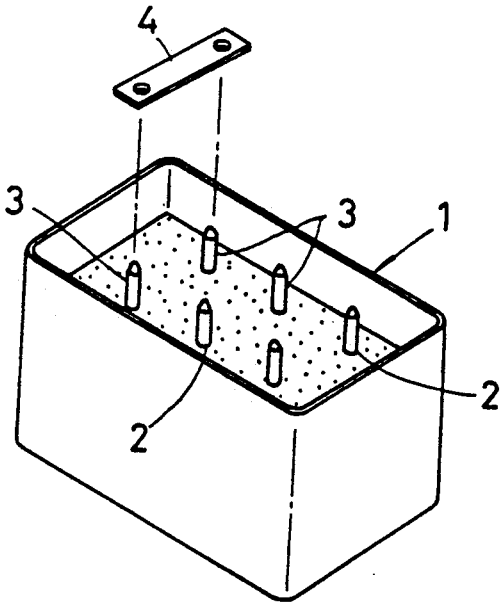
FIG. 5 PRIOR ART
FIG. 5 is a perspective view of a conventional connector.

In FIG. 4, the connector is assembled by press fitting the respective terminal pins of the linear shunt terminals 10 and the interconnected shunt terminal 14 into corresponding receiving apertures 17.

By mixing linear shunt terminals 10 and interconnected shunt terminals 14 or using either linear shunt terminals 10 or interconnected shunt terminals 14 alone, it is easy to provide any short circuit configuration of terminal pins. Both the linear shunt terminals 10 and the interconnected shunt terminals 14 are made by integrating terminal pins and shunting plates so that connections between the terminal pins Il are very reliable. In addition, it is possible to eliminate the shunting plates, reducing the number of parts and thus the part management cost.

I claim:

1. An electrical connector terminal comprising:

a connector housing made from an insulation material and having a plurality of receiving apertures and at least one interconnected shunt terminal each having a plurality of terminal pins aligned in a line, said parallel linear shunt terminals joined together with a cross linkage strip which is made from a conductive material, with said terminal pins press fitted through said receiving apertures such that the number of said terminal pins of one of said linear shunt terminals being different from that of the other said shunt terminal on either side of said cross linkage strip.

* * * * *